US005341732A

United States Patent [19]

Landers

[11] Patent Number: 5,341,732

[45] Date of Patent: Aug. 30, 1994

[54] IMPELLER GUN SAFETY TRIGGER MECHANISM

[76] Inventor: Norman R. Landers, 404 Kenova Rd., Smackover, Ark. 71762

[21] Appl. No.: 44,807

[22] Filed: Apr. 12, 1993

[51] Int. Cl.[5] ..... B44B 5/00; B44B 5/02

[52] U.S. Cl. ..... 101/3.1; 42/70.06; 101/18

[58] Field of Search ..... 101/3.1, 4, 18; 42/70.01, 70.06, 66, DIG. 1

[56] References Cited

U.S. PATENT DOCUMENTS

| | | | |
|---|---|---|---|
| 1,360,950 | 11/1920 | Herren | 42/70.06 |
| 3,327,623 | 6/1967 | Diegel | 101/3.1 |
| 4,006,786 | 2/1977 | Speicher | 101/3.1 |
| 4,793,063 | 12/1988 | Ducret | 30/360 |
| 5,025,582 | 6/1991 | Mote, Sr. | 42/20.06 |

FOREIGN PATENT DOCUMENTS

| | | | |
|---|---|---|---|
| 0050926 | 4/1980 | Japan | 101/3.1 |

*Primary Examiner*—Edgar S. Burr
*Assistant Examiner*—Lynn D. Hendrickson
*Attorney, Agent, or Firm*—E. Michael Combs

[57] ABSTRACT

A trigger gun to impart a stamp member in engagement with a face to permit identification of an associated workpiece is provided, wherein a trigger safety mechanism is arranged to provide for selective release of a first trigger upon pivoting of a second trigger to displace a second trigger link from a first trigger receiving slot permitting actuation of the first trigger to effect actuation of an associated impact mechanism within the gun.

4 Claims, 4 Drawing Sheets

FIG. 3
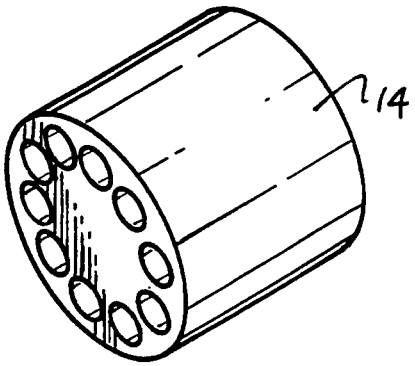
FIG. 4
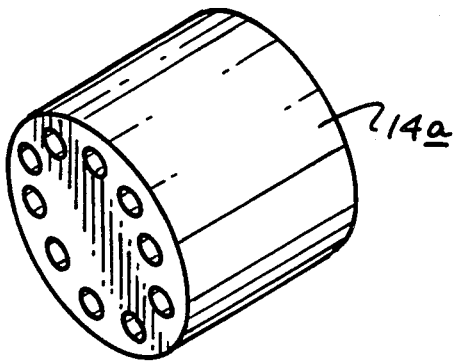
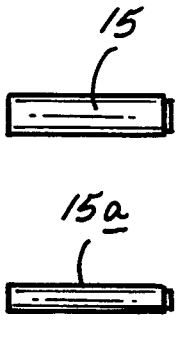
FIG. 5
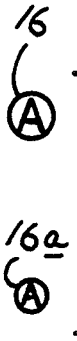
FIG. 6

IMPELLER GUN SAFETY TRIGGER MECHANISM

BACKGROUND OF THE INVENTION

1. Field of the Invention

The field of invention relates to impact gun structure, and more particularly pertains to a new and improved impeller gut, safety trigger mechanism wherein the same is directed to the imparting of die stamps onto a workpiece and a safety mechanism associated therewith.

2. Description of the Prior Art

Gun structure for marking in a tool organization is indicated in U.S. Pat. No. 3,847,078 to Krembel utilizing a die arranged for impact relative to a workpiece. Further stamping tool structure is available in the prior art utilizing either electric or pneumatic pressure for actuation of a ram.

The instant invention is directed to the use of die stamps mounted within a magazine with a safety trigger structure availed to avoid inadvertent actuation of the drive mechanism in use and in this respect, the present invention substantially fulfills this need.

SUMMARY OF THE INVENTION

In view of the foregoing disadvantages inherent in the known types of impact gun structure now present in the prior art, the present invention provides an impeller gun safety trigger mechanism wherein the same is directed to the use of a safety mechanism in operative association with a gun structure. As such, the general purpose of the present invention which will be described subsequently in greater detail, is to provide a new and improved impeller gun safety trigger mechanism which has all the advantages of the prior art impeller gun structure and none of the disadvantages.

To attain this, the present invention provides a trigger gun to impart a stamp member in engagement with a face to permit identification of an associated workpiece, wherein a trigger safety mechanism is arranged to provide for selective release of a first trigger upon pivoting of a second trigger displace a second trigger link from a first trigger receiving slot permitting actuation of the first trigger to effect actuation of an associated impact mechanism within the gun.

My invention resides not in any one of these features per se, but rather in the particular combination of all of them herein disclosed and claimed and it is distinguished from the prior art in this particular combination of all of its structures: for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which, will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved impeller gun safety trigger mechanism which has all the advantages of the prior art impeller gun structure and none of the disadvantages.

It is another object of the present invention to provide a new and improved impeller gun safety trigger mechanism which may be easily and efficiently manufactured and marketed.

It is a further object of the present invention to provide a new and improved impeller gun safety trigger mechanism which is of a durable and reliable construct-/on.

An even further object of the present invention is to provide a new and improved impeller gun safety trigger mechanism which is susceptible of a low cost of manufacture with regard to both materials and labor, and which accordingly is then susceptible of tow prices of sale to the consuming public, thereby making such impeller gun safety trigger mechanisms economically available to the buying public.

Still yet another object of the present invention is to provide a new and improved impeller gun safety trigger mechanism which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of a first magazine for use by the invention.

FIG. 4 is an isometric illustration of a second magazine for use by the invention.

FIG. 5 is an orthographic view of stamp members for use in a magazine, as indicated in FIGS. 3 and 4.

FIG. 6 is an orthographic end view of the stamp members, as indicated in FIG. 5.

DESCRIPTION OF THE PREFERRED EMBODIMENT

Figure 1:
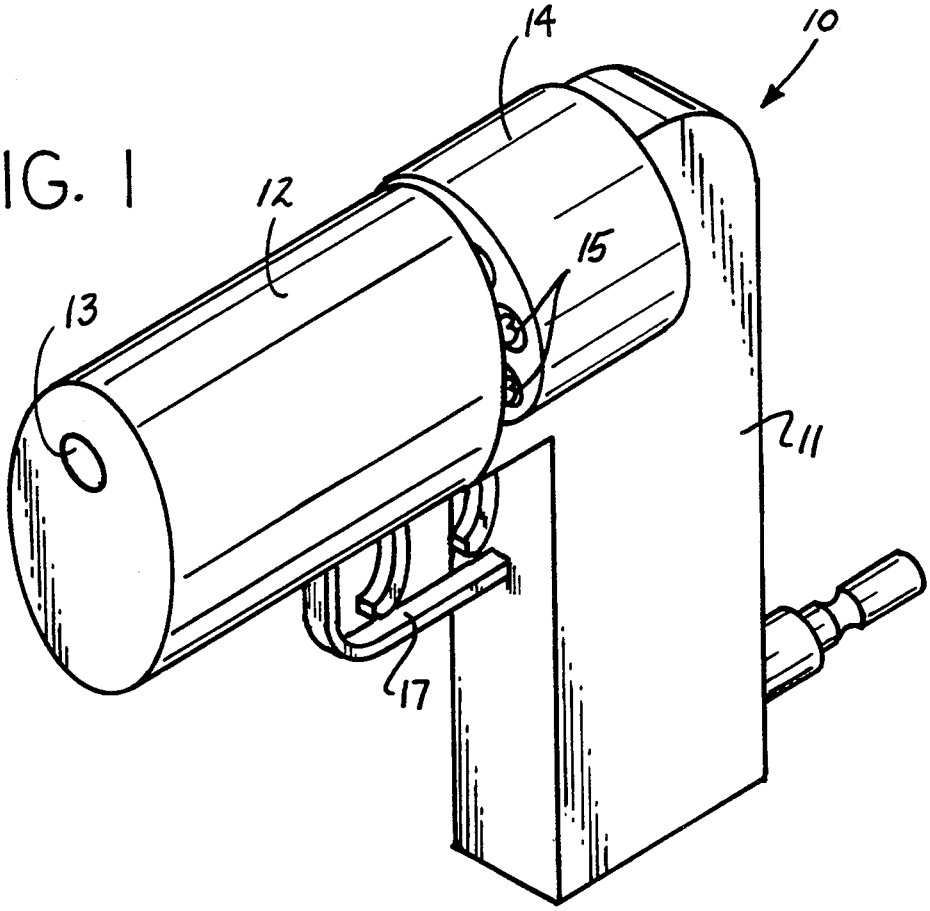
FIG. 1 is an isometric illustration of the invention.
Figure 2:
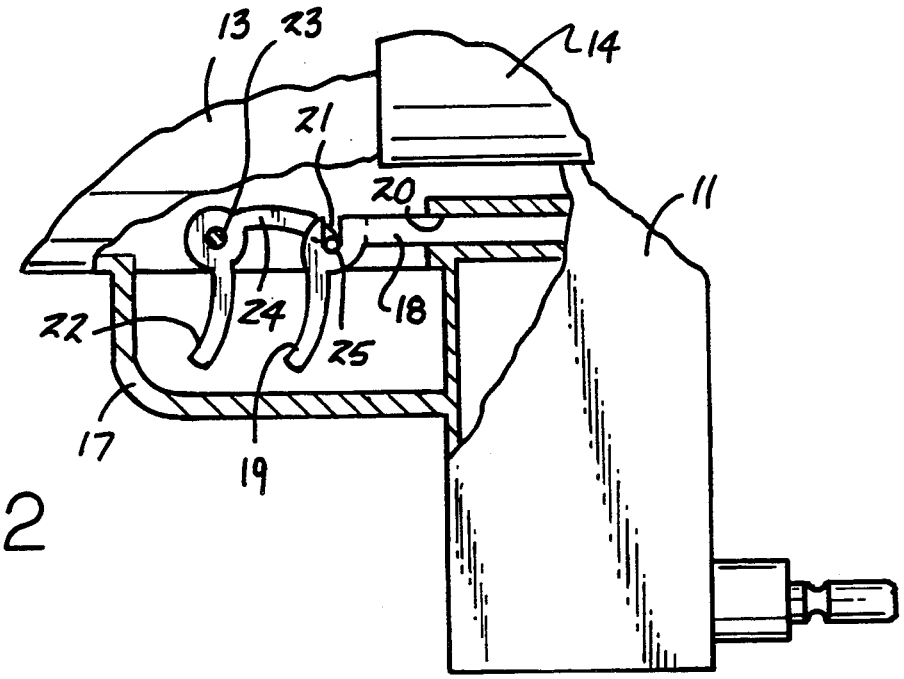
FIG. 2 is an enlarged orthographic view, partially in section, of the spaced first and second triggers of the structure.

With reference now to the drawings, and in particular to FIGS. 1 to 10 thereof, a new and improved impeller gun safety trigger mechanism embodying the principles and concepts of the present invention and generally designated by the reference numerals 10 and 10a will be described.

More specifically, the impeller gun safety trigger mechanism 10 of the invention essentially comprises cooperation with an impact gun, having a gun housing 11 cooperative with a gun barrel 12 that in turn includes a gun barrel bore 13 directed coextensively through the gun barrel, with a magazine 14 interposed between the gun housing 11 and the barrel 12. The magazine 14 is arranged for rotation, in a manner to include axles, lock pins, and the like (not shown, wherein the magazine, 14 includes magazine chambers arranged in a parallel relationship in an annular array, as indicated in FIG. 3, wherein FIG. 4 indicates a secondary magazine 14*a* having the secondary magazine chambers in a like mannered configuration such that respective marking dies and secondary marking dies 15 and 15*a* respectively are received within the respective magazines 14 and 14*a* to permit the marking dies to impact a workpiece when they are projected from the magazine through the barrel utilizing pneumatic electric structure. A pneumatic impact structure is indicated in the U.S. Pat. No. 3,847,078 incorporated herein by reference as an example of mechanism available in the prior art. The stamps are provided with stamp faces 16 and 16*a* respectively relative to the marking and secondary marking dies 15 and 15*a*. As indicated in FIG. 1, a pneumatic nipple is utilized should pneumatic pressure be employed, wherein FIG. 9 indicates the use of an electric coupler to afford electrical communication with an electric drive mechanism should such a drive mechanism be employed by organization.

A trigger guard 17 is provided in fixed securement to the barrel 12 and the gun housing 11 An actuator rod 18 reciprocatably mounted within an actuator rod bore 20 that in turn is positioned within the gun member in adjacency to the housing is arranged to provide for a trigger for the actuation of the drive mechanism such that a first trigger 19 is fixedly mounted to a forward end of the actuator rod 18, with the trigger 19 having a first trigger slot 21 directed into the first trigger at an intersection of the first trigger with the actuator rod 18. A second trigger 22 is positioned in a spaced forward relationship relative to the first trigger pivotal about a second trigger pivot axle 23, with a second trigger link 24 fixedly mounted to the second trigger such that pivoting of the second trigger 22 effects pivoting of the second trigger link 24 about the pivot axle 23. The second trigger link 24 includes a trigger link lock leg 25 arranged for selective reception within the first trigger slot 21. With the second trigger lock leg 25 received within the first trigger slot 21, the first trigger prevented from actuation and reciprocation preventing the actuator rod 18 from reciprocating within -the actuator rod bore 20.

Figure 7:
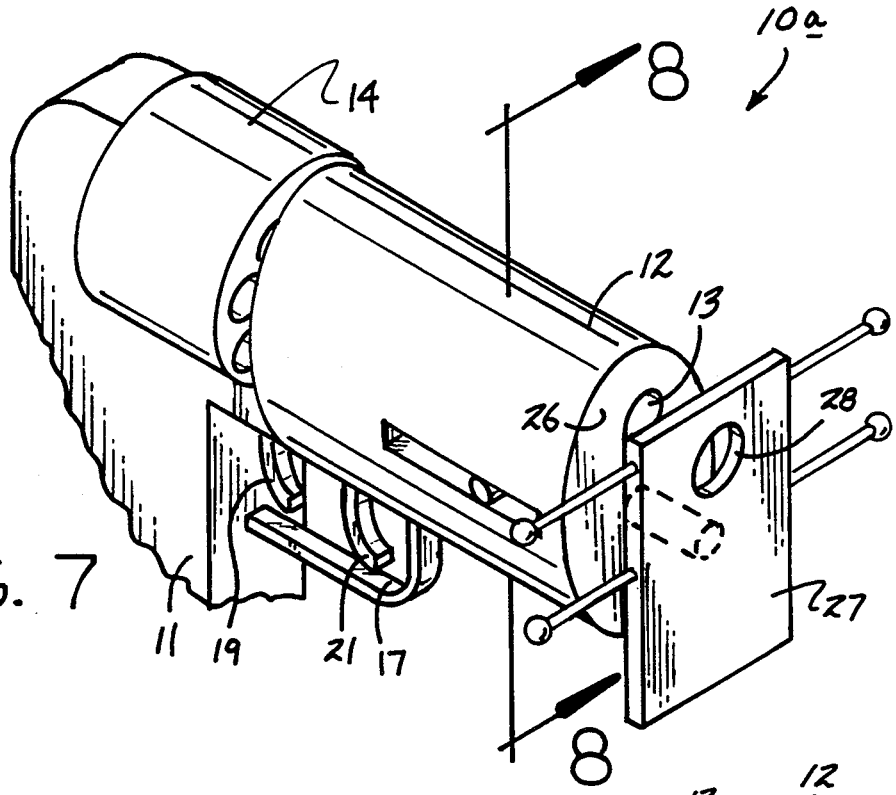
FIG. 7 is an isometric illustration of a modified structure as employed by the invention.
Figure 8:
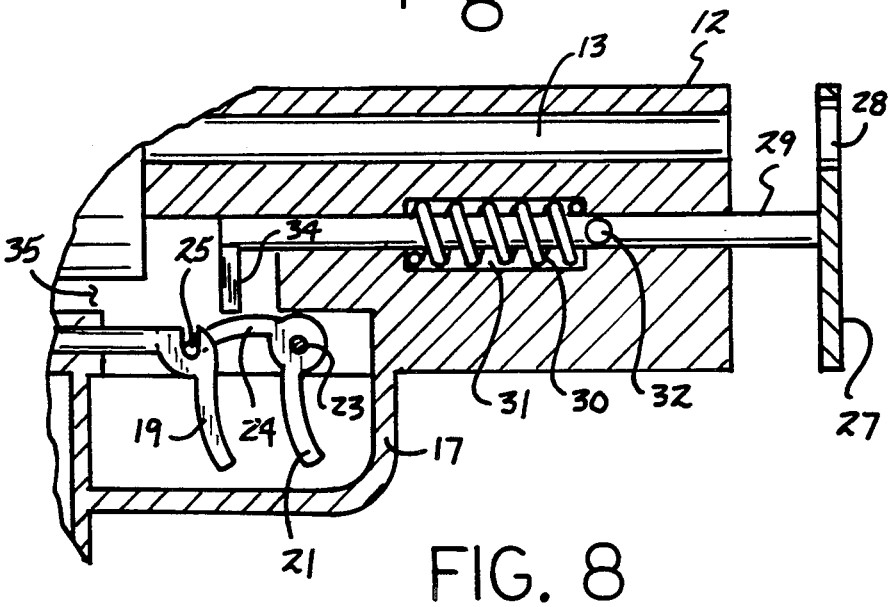
FIG. 8 is an orthographic view, taken along the lines 8—8 of FIG. 7 in the direction indicated by the arrows.
Figure 9:
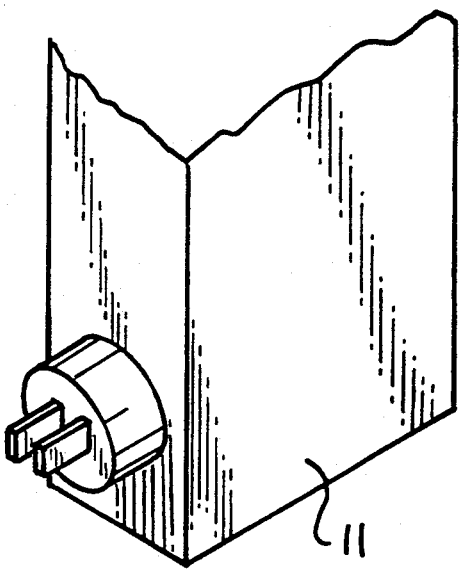
FIG. 9 is an isometric illustration of the housing structure to employ electrical connector plug.

The FIG. 7 and FIG. 8 include an abutment plate 27 mounted in adjacency to the barrel front end wall 26 that is spaced from the magazine 14 such that the abutment plate 27 includes an abutment plate aperture 28 that is coaxially aligned with the barrel bore 13. An abutment plate slide rod 29, typically of planar configuration, is slidably received in a parallel relationship through the gun barrel parallel to the gun barrel bore 13, with a spring cavity 31 receiving a slide rod 29 therethrough, and spring member wound about the slide rod and received within the spring cavity 31 such that the slide rod having a slide rod lug 32 compresses the spring 30 within the spring cavity 31, wherein in a normal first position, the abutment plate 27 is spaced from the barrel front end wall 26, wherein a slide rod abutment boss 34 fixedly mounted to a rear distal end of the slide rod 29 spaced from the abutment plate is positioned in adjacency to the second trigger link 24 to prevent its rotation, and accordingly prevent displacement of the trigger link lock leg 27 relative to the first trigger slot 21 to thereby further prevent actuation of the gun mechanism. To displace the slide rod abutment boss 34, an operator merely directs the abutment plate 27 in engagement with a workpiece to be marked thereby displacing the abutment boss 34 within the trigger housing cavity 35, as indicated in FIG. 8.

Figure 10:
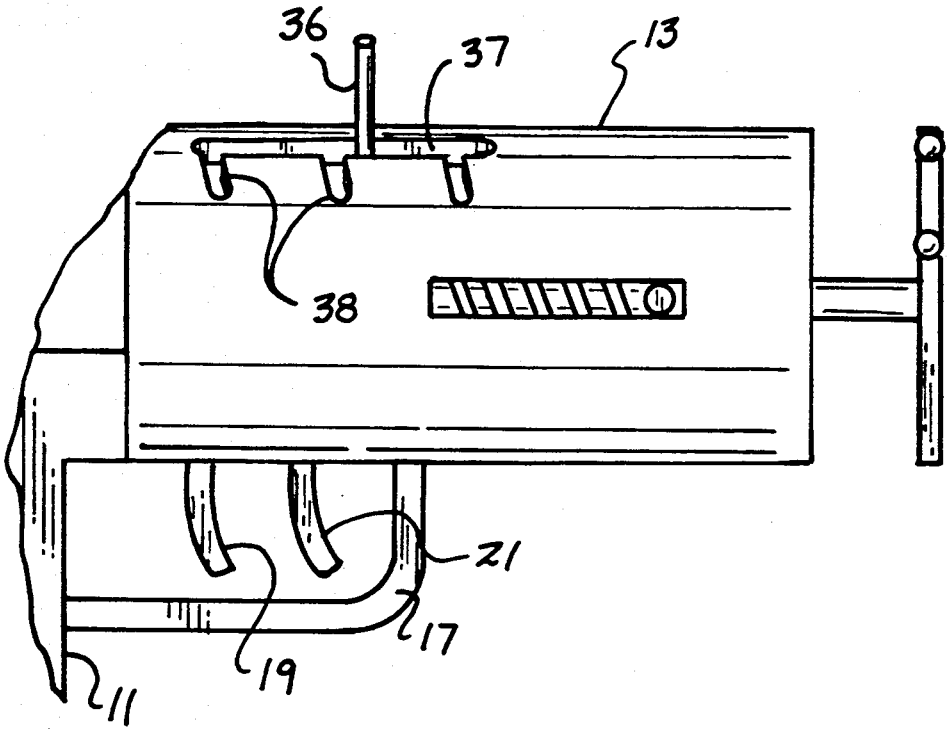
FIG. 10 is an orthographic side view of the invention employing an optionally utilized cocking mechanism.

The FIG. 10 indicates the use of a convenient manner of providing, if required, a cocking lever 36 relative to the mechanism, as the cocking lever 36 is slidably received within the cocking lever slot 37, wherein safety slots 38 intersect the cocking lever slot 37 for receiving the cocking lever 36 therewithin in a locked orientation.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A gun safety mechanism, comprising, a gun housing, and a gun barrel mounted to the gun housing, with a magazine interposed between the gun barrel and the gun housing, the magazine including an annular array of bores directed therethrough, with the gun barrel having a gun barrel bore, and one of said magazine bores aligned with the barrel bore, and the magazine receiving at least one elongate marking die therewithin, an actuator rod bore positioned adjacent said housing, and a first trigger, having an actuator rod fixedly mounted to the first trigger, with the actuator rod slidably received within the actuator rod bore, and a second trigger, the second trigger having a second trigger pivot axle, and the second trigger pivot axle fixedly secured to the gun housing in adjacency to the barrel, with the second trigger including second trigger lock means for selective locking of the first trigger relative to the second trigger.

2. A gun safety trigger as set forth in claim 1 wherein the lock means includes a second trigger link fixedly mounted to the second trigger, and the first trigger having a slot directed into the first trigger at an intersection of the first trigger and the actuator rod, with the second trigger link including a trigger link lock leg selectively received within the slot, whereupon pivoting of the second trigger effects selective displacement of the trigger link lock leg relative to the slot.

3. A gun safety trigger as set forth in claim 2 wherein the barrel includes a barrel front end wall and an abutment plate positioned in adjacency to the barrel front end wall, with the abutment plate having an abutment plate aperture; coaxially aligned with the barrel bore, and the abutment plate including a slide rod slidably received within the barrel in a parallel relationship relative to the barrel bore, and a spring cavity, and the slide rod slidably received through the spring cavity, .and a spring member captured within the spring cavity, the slide rod having a slide rod lug arranged for engagement with the spring member for biasing the slide rod lug and the slide rod and the abutment plate in a spaced relationship relative to the, barrel front end wall.

4. A gun safety trigger as set forth in claim 3 wherein the slide rod has a slide rod first end mounting the; abutment plate, the slide rod having a second end, and the barrel having a trigger housing cavity, and the slide rod second end including a slide rod abutment boss orthogonally and fixedly mounted to the slide rod second end, and the slide rod abutment boss arranged in adjacency to the second trigger link when the abutment plate is in a spaced relationship relative to the barrel front end wall, and wherein the slide rod abutment boss is displaced relative to the second trigger link when the abutment plate is in engagement with the barrel front end wall.

* * * * *